United States Patent [19]

Osaki

[11] Patent Number: 4,802,401

[45] Date of Patent: Feb. 7, 1989

[54] PNEUMATICALLY MOVABLE DEVICE WITH A SAFETY LOCK MEANS

[75] Inventor: Kouichi Osaki, Gunma, Japan

[73] Assignee: Ichikoh Engineering, Ltd., Maebashi, Japan

[21] Appl. No.: 81,210

[22] Filed: Aug. 3, 1987

[30] Foreign Application Priority Data

Jan. 20, 1987 [JP] Japan ..... 62-009047

[51] Int. Cl.[4] ..... F15B 15/26

[52] U.S. Cl. ..... 91/44; 91/45; 91/189 A

[58] Field of Search ..... 91/41, 43, 44, 45, 189 R, 91/189 A, 407, 410; 92/27, 28

[56] References Cited

U.S. PATENT DOCUMENTS

| | | | |
|---|---|---|---|
| 2,582,030 | 1/1952 | Halward | 91/44 |
| 3,072,074 | 1/1963 | Lunde et al. | 91/44 X |
| 3,141,382 | 7/1964 | Oldfield et al. | 91/44 |
| 3,270,621 | 9/1966 | DeRidder | 91/44 |
| 3,348,454 | 10/1967 | Kahn et al. | 91/44 |

*Primary Examiner*—Robert E. Garrett
*Assistant Examiner*—Mark A. Williamson
*Attorney, Agent, or Firm*—Jordan and Hamburg

[57] ABSTRACT

A pneumatically movable device with a safety lock means having a movable member, a pneumatic actuator connected to the movable member and adapted to move the movable member and a direction control valve connected to the actuator. A cylinder for locking is connected between one of the ports of the cylinder and the direction control valve. A spring is disposed in the cylinder for locking. Openings provided at a chamber at a side of the spring are connected to the actuator and the directional control valve respectively through a check valve disposed for preventing the air from flowing into the cylinder for locking. Openings provided at a chamber at a side remote from the spring are connected to on one hand to the actuator through a check valve disposed for preventing the air from flowing into the cylinder for locking and on the other hand to the directional valve through the check valve with a restrictor disposed for preventing the air from flowing into the direction control valve. A locking member is attached to the piston rod of the cylinder for locking and an engaging member engageable with the locking member is attached to the movable member.

4 Claims, 6 Drawing Sheets

PNEUMATICALLY MOVABLE DEVICE WITH A SAFETY LOCK MEANS

BACKGROUND OF THE INVENTION AND RELATED ART STATEMENT

The present invention relates to a pneumatically movable device with a safety lock means and more specifically to a pneumatically movable device capable of locking a movable member at a specified location, the movable member, such as a chuck holding plate or the like in a robot system for extracting injection molded or die cast products being adapted to be rotated or linearly moved by a pneumatic actuator.

In a prior art robot system for extracting injection molded or die cast products, the chuck holding plate with the chuck means adapted to grip the molded or cast product is caused to be rotated by a pneumatic actuator such as a pneumatic cylinder and may be held at a specified posture by the pneumatic pressure applied to the pneumatic cylinder.

In the prior art chuck holding plate, there have been such problems as the chuck holding plate may be caused to be inclined or otherwise unintentionally moved due to the application of load at a time of rapid vertical movement of the arm of the robot system or due to overload or to any shock aplied to the chuck holding plate in itself or due to leakage of air from the pneumatic cylinder.

Although such method of locking the chuck holding plate at a specified position as by using a pin or the like has been studied, that method was cumbersome.

SUMMARY OF THE INVENTION

The present invention has as an object to provide a pneumatically movable device which will eliminate the above-mentioned prior art problems relating and which can be readily and positively locked so as to avoid unnecessary movement of the movable member.

The above-mentioned object has been attained in the present invention by providing a pneumatically movable device with a safety locking means wherein the cylinder for locking a piston rod provided with a locking member adapted to lock the movable member by engagement with the engaging member provided at said movable member is disposed in the supply path for the compressed air to the actuation. The cylinder for locking the actuator and the direction control valve for switching operation of the actuator are connected to each other through check valves or check valves with throttle means. When the actuator is in an inoperative condition, the locking member is held at the engagement position by the piston rod of the cylinder for locking due to the urging pressure by a spring. When the direction control valve is switched upon energization of the actuator, the compressed air causes the piston rod to be moved against the urging pressure of a spring, and the engaging member is moved to the engagement releasing position. After the locking member is moved to the engagement releasing position, the compressed air which flows through the cylinder for locking is allowed to flow into the actuator. When the direction control valve is switched so that the actuator is restored to the inoperative condition, the air is exhausted by the cylinder for locking, the piston rod is caused to move by the urging pressure of a spring and after the locking member is moved to the engagement position, the compressed air is exhausted by the actuator through the cylinder for locking.

According to the present invention, even if shock is imposed on the chuck holding plate due to higher speed of the vertical movement of the chuck body and the weight of the attachment to be attached to the chuck holding plate is increased, the chuck holding plate may be prevented from unnecessary tilting. The chuck holding plate therefore withstands the high speed movement of the movable member. It has therefore also become possible to reliably attach a heavy article to the movable member.

DESCRIPTION OF THE PREFERRED EMBODIMENT

The present invention will now be explained in greater detail with reference to the embodiment shown in the accompanying drawings.

Figure 1:
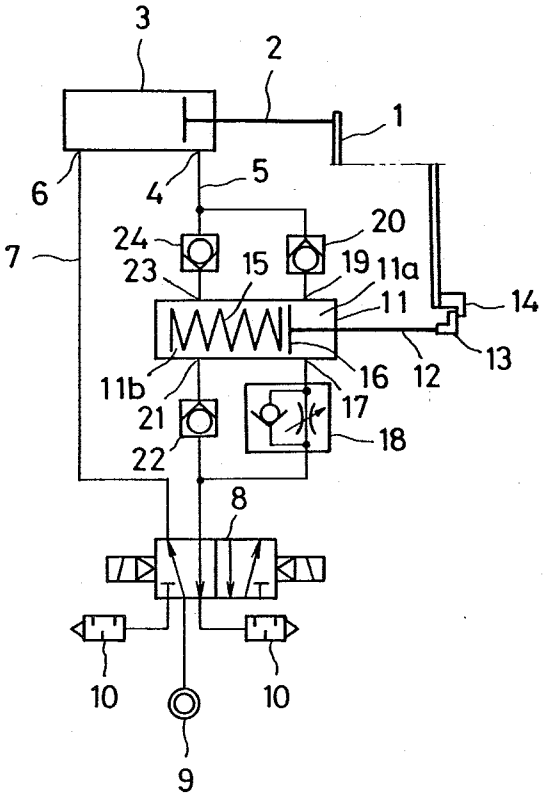
FIG. 1 is a schematic illustrating the principle of the present invention.

In FIG. 1, there is shown an example in which the air cylinder 3 having a piston rod 2 coupled to a movable member 1, for example a chuck holding plate of a robot system for extracting injection molded or die cast products, and adapted to move the movable member 1 is used as an actuator.

The first air port 4 and the second air port 6 of the air cylinder 3 are connected respectively through the conduit tubes 5 and 7 to the direction control valve 8, such as 5-way 2-position double acting solenoid valve. The direction control valve 8 is in turn connected to the compressed air source 9 and to the atmosphere through the silencers 10.

The cylinder 11 for locking (locking cylinder 11) is interposed in the path defined by the connecting of the first air port 4 through the conduit 5 with the direction control valve 8.

A locking member 13 is attached to the rod 12 for the locking cylinder 11. When the locking member 13 is at the engagement position, it is engaged by the engaging member 14 provided at the movable member.

Within the locking cylinder 11 is disposed a spring 15 which urges the piston 16 having the rod 12 toward the engagement position. In the locking cylinder 11, there are defined with the piston as the partition a chamber **11*b* to the side of the spring 15 and a chamber 11*a* at the side remote from the spring 15. The first port 17 formed in the chamber 11*a* is connected to the direction control valve 8 through a check valve 18** with a restrictor (orifice or throttle) or check valve with a variable restrictor in the example shown in FIG. 1 while the second port 19 is connected to the first air port 4 of the air cylinder through the check valve 20. In this case the check valve 18 and the check valve 20 are so constructed as to allow the air to flow into the chamber 11*a* of the locking cylinder 11 but to prevent the air to flow out of the chamber 11*a*. The third port 21 formed in the chamber *11b* is connected to the direction control valve 8 through the check valve 22 while the fourth port 23 is connected to the first air port 4 of the air cylinder 3 through the check valve 24. In this case, the check valves 22, 24 are so constructed as to prevent the air from flowing into the locking cylinder 11 but allow the air to flow from the locking cylinder 11.

Figure 2:
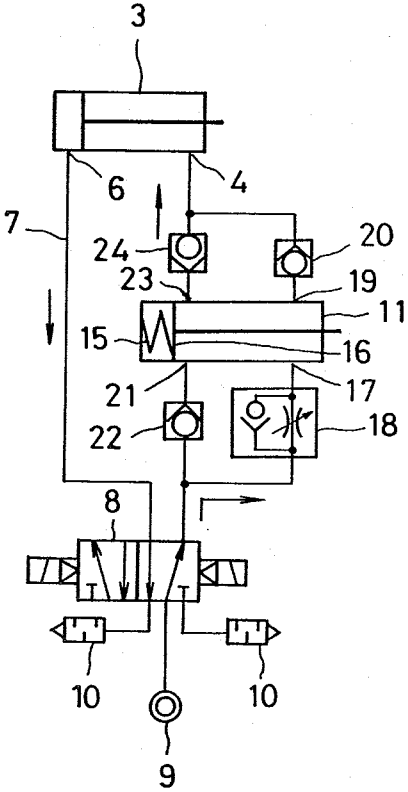
FIG. 2 corresponds to FIG. 1 but showing the operation to release locking, FIG. 3 corresponds to FIG. 1 but showing the operation for locking.

When the position control valve 8 is switched as shown in FIG. 2, the compressed air is caused to be supplied to the chamber 11*a* through the check valve with throttling means (speed controller) 18 and since the check valve 20 is preventing the air from flowing into the air cylinder 3 from the chamber 11*a*, the piston 16 will be pressed to the position shown in FIG. 2 against the pressure of the spring 15. At this instance, the locking member 13 is spaced from the engaging member 14, i.e., the locking member 13 and the engaging member 14 are not locked together.

When the piston 16 is moved to the position shown in FIG. 2, the four ports 17, 19, 21, and 23 of the locking cylinder 11 are all caused to communicate with the chamber 11*a*, whereby the air which flows into the chamber 11*a* through the first port 17 is caused to flow out through the fourth port 23 to the first air port 4 of the cylinder 3 through the check valve 24.

The piston rod of the cylinder 3 is pressed and moved by the air and the movable member 1 is moved together with the rod 2. The air in the cylinder 3 is then exhausted through the second air port 6 of the cylinder 3 and through the direction control valve 8.

Figure 4:
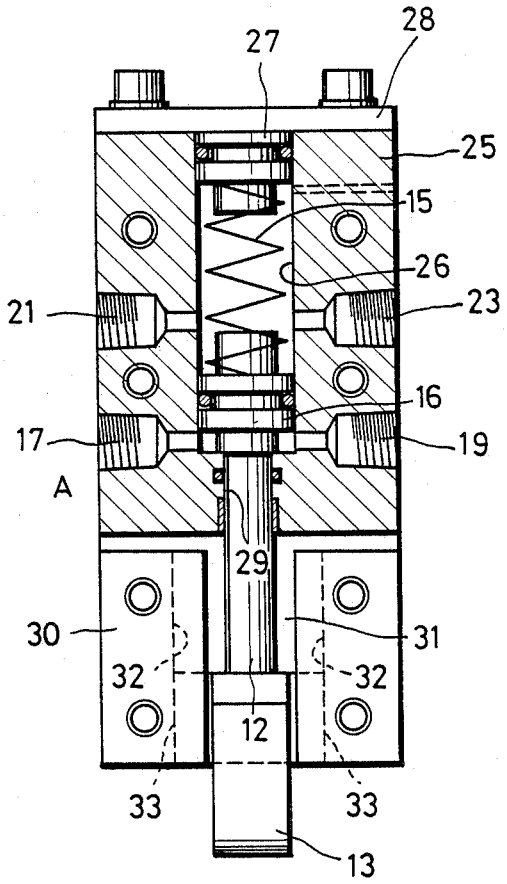
FIG. 4 is a sectional view of the cylinder for locking according to the present invention.

If the direction control valve 8 is switched in the condition shown in FIG. 2, the third port 21 of the locking cylinder 11 will be opened to the atmosphere through the direction control valve 8 as illustrated in FIG. 2, and the air in the air cylinder 3 is exhausted through the first air port 4, the check valve 20, the second port 19 and the third port 21 of the locking cylinder 11, the check valve 22 and the direction control valve. And at the same time the air is supplied to the air cylinder 3 at the second air port 6 through the direction control valve 8. This will cause the piston rod 2 to be moved out from the cylinder 3, so that the movable member 1 will be returned to the initial position. Since the air pressure in the chamber 11*a* is maintained at a specified level during the period of movement of the piston rod 2 for a predetermined distance, the piston 16 will be held at the lock releasing position shown in FIG. 2. When the piston rod 2 is moved to a specified position, the air flow rate from the air cylinder 3 will be reduced and the pressure in the chamber 11*a* is reduced so that the piston 16 will be pressed by the action of the spring 15 and restored to the condition shown in FIG. 1, as the chamber 11*b* communicates with the atmosphere through a canal 34 (FIG. 4). After the piston 16 has isolated the communication between the third port 21 and the chamber 11*a*, the air will be exhausted through the speed controller 18 and the air discharging speed is controlled at a specified value. This enables the moving speed in general of the rod 12 and, if requried, the moving speed of the rod 12 immediately before its stoppage to be controlled.

Owing to the above-mentioned movement, the movable member may be caused to move after the locking condition has been released by the action of the locking cylinder and the locking cylinder may be energized to execute locking after the movable member has reached the position for locking.

In the above explanation, reference has been made an example in which the locking cylinder is provided at only one of the pipe-lines for the cylinder 3. It should be noted that the locking cylinders may be provided at both of the pipe-lines to lock the movable member at two movement positions.

Figure 6:
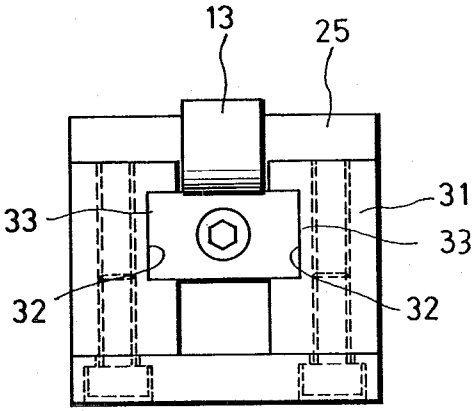
FIG. 6 is the bottom view of the cylinder of FIG. 4.

An embodiment of the locking cylinder 11 will be explained with reference to FIG. 4 through FIG. 6.

Into the through bore 26 of the cylinder case 25 are inserted the piston 16 and the spring seat 27. An end portion of the through bore 26 at the back face of the spring seat 27 is closed by the lid 28. Between the spring seat 27 and the piston 26 is tensioned a spring 15. At the end of the cylinder case remote from the lid 28, there is formed a bore 29 of a smaller diameter in which the rod 12 attached to the piston 16 is slidably guided. At the end portion of the through bore 26 adjacent to the bore 29, the first port 17 and the second port 19 pass through the cylinder case 25 in communication with the bore 26. The through bore 26 is separated by the piston in sealed condition into the chamber 11*b* at the side of the spring 15 and the chamber 11*a* at the side remote from the spring 15.

The third port 21 and the fourth port 23 pass through the cylinder case 25 in communication with the bore 26 at a location where they are included in the chamber 11*b* when the rod 12 is caused to be projected by the piston 16 under pressure by the spring 15 and are included in the chamber 11*a* when the rod 12 is retracted by the piston 16 counter to the spring action.

The spring seat 27, the piston 16 and respective rod 12 are sealed by the seal members and so constructed to prevent leakage of the air.

At the other end of the rod 12 is attached a locking member 13 such as a hook.

In order to enable the hook 13 to be moved in a true path, a guide member 31 is provided at the base 30 which secures the cylinder case 25, guide grooves 32 are formed on the guide member 31 and guide projections 33 slidably guided in the guide grooves 32 are provided on said hook 13.

Figure 5:
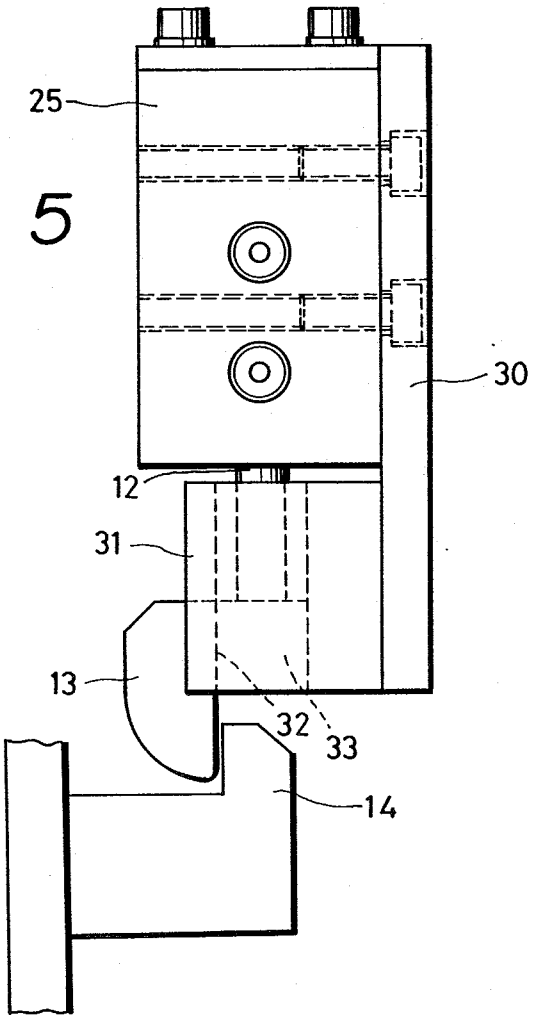
FIG. 5 is the right side view of the cylinder of FIG. 4.

At the position where the rod 12 is projected, the engaging member 14, such as an engagement claw provided on the movable member 1 is engaged by the hook 13 as shown in FIG. 5, so that the movable member 1 is locked.

Figure 7:
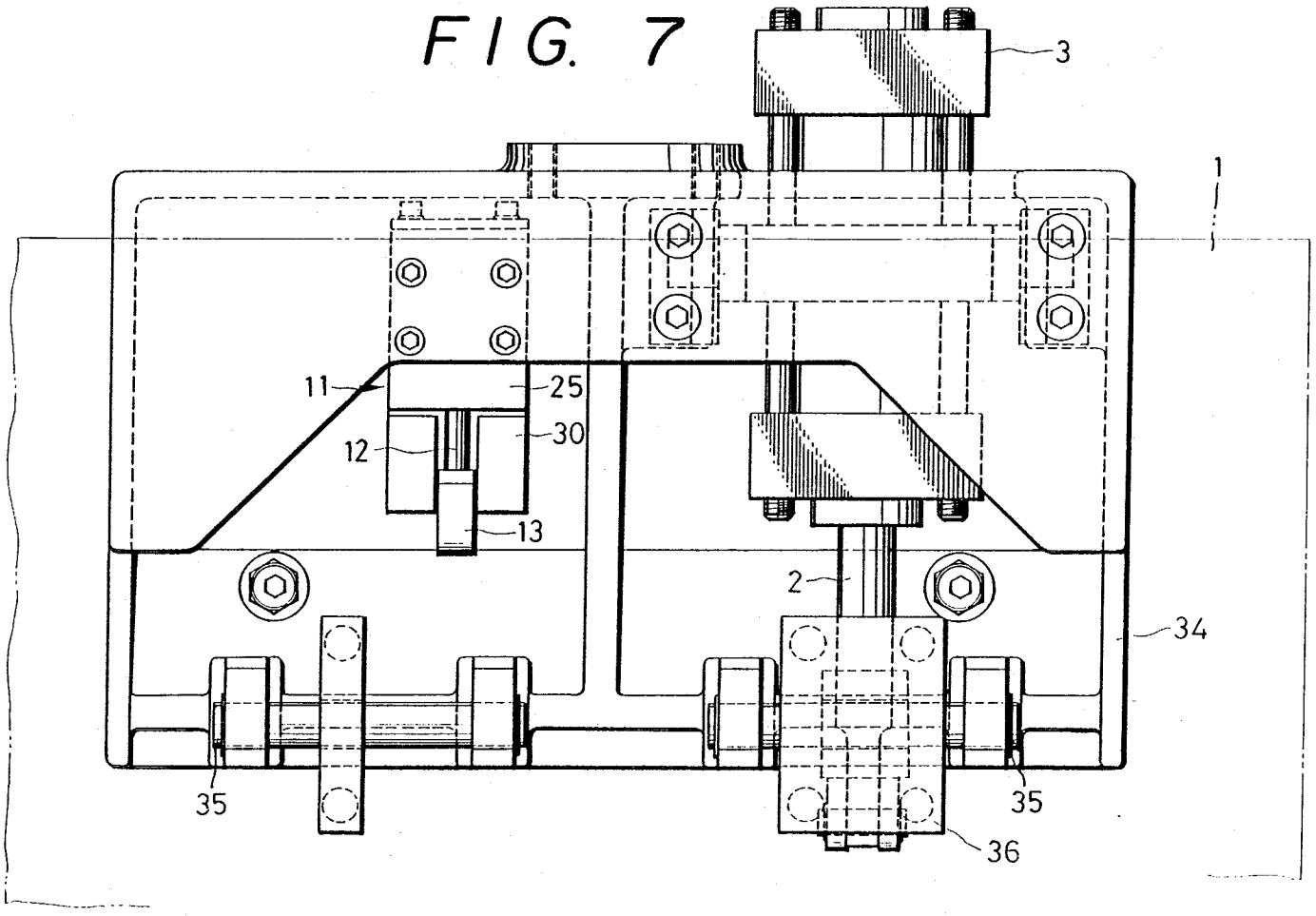
FIG. 7 is a front view showing the chuck body for the robot system and the chuck holding plate as an example of the movable device according to the present invention.
Figure 8:
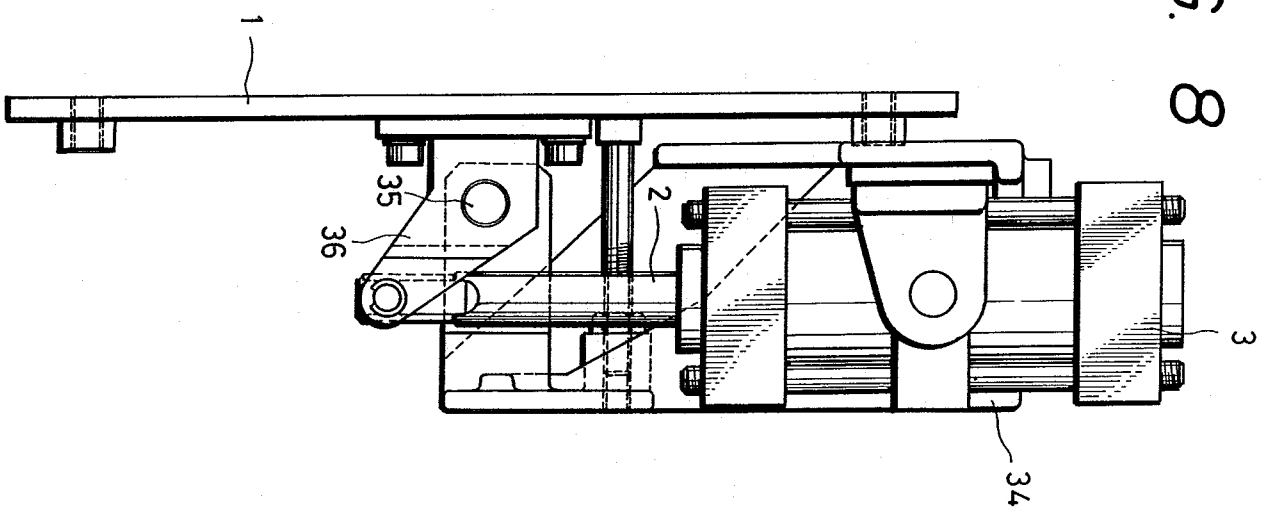
FIG. 8 is the right side view of the device of FIG. 7.

An example of the chuck holding plate of the robot system for extracting injection molded or die cast products used as the movable member 1 is as shown in FIG. 7 and FIG. 8. The chuck holding plate 1 is rotatably supported by a shaft 35 on the chuck body 34 and constitutes the movable member. In this embodiment, the movable member is moved not linearly but rotationally. On the chuck holding plate 1 are secured the brackets 36 rotatably supported on the shaft 35. To the brackets 36 is connected the rod 2 of the cylinder 3 supported by the chuck body 34, so that the chuck holding plate 1 is caused to rotate around the shaft 35 by energization of the cylinder 3. The locking cylinder 11 is fixed to the chuck body 34 in the manner shown in FIG. 7 and FIG.

9. The engagement claw 14 is secured to the chuck holding plate 1.

Figure 9:
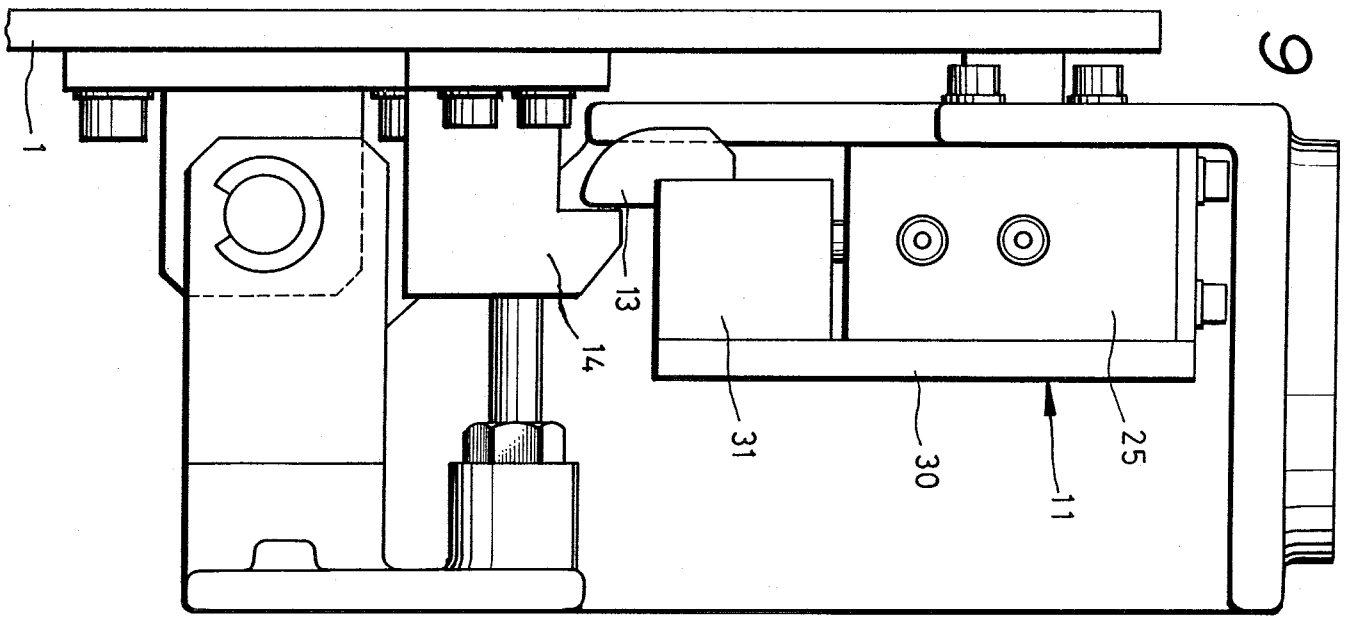
FIG. 9 is a view with the cylinder and the related portion.

At the position in which the chuck holding plate 1 is upstanding substantially vertically as shown in FIG. 9, the hook 13 is engaged with the engagement claw 14 and thus the chuck holding plate 1 is locked at this position.

Figure 3:
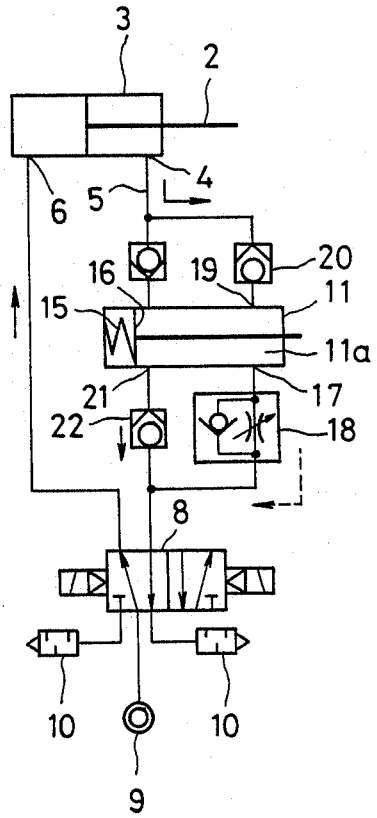

As explained above by referring to FIG. 1 through FIG. 3, when the hook 13 constituting the engaging member is pulled upwardly (FIGS. 5 and 9), the engagement of the hook with the engagement claw 14 is released and thus the locking of the chuck holding plate is released. The chuck holding plate 1 is then caused to be rotated counterclockwise around the shaft 35 (FIG. 8) to a substantially horizontal posture by the action of the cylinder 1.

In order to restore the chuck holding plate 1 to the posture shown in FIG. 8, the chuck holding plate 1 is firstly to be caused to rotate in the clockwise direction by activation of the cylinder 3. After the chuck holding plate 1 has been returned to the condition shown in FIG. 8 and FIG. 9, the locking cylinder 11 will be so activated that the hook 13 is lowered (FIG. 9) and engages with the engaging claw 14 to lock movement of the chuck holding plate 1.

What is claimed is:

1. A pneumatically movable device with a safety lock means comprising:

a movable member, a pneumatic actuator connected to said movable member and adapted to move said movable member and having first and second air ports, a direction control valve connected to said first and second air ports of said actuator, a locking cylinder connected between said first air port and said direction control valve and having a piston disposed in said cylinder and a spring disposed in said cylinder, the spring pressing against one side of the piston, a first chamber being defined in the cylinder at the side of the piston where the spring is located and a second chamber being defined in the cylinder at the other side of the piston, a first two openings provided in the first chamber and being respectively connected to said first air port of the actuator and to said direction control valve through respective check valves, the check valves being so arranged as to prevent air from flowing into said cylinder, a second two openings provided in the second chamber, a first of said second two openings being connected to said first air port of the actuator through a check valve being so arranged as to prevent air from flowing into the locking cylinder and a second of said second two openings being connected to said directional control valve through an other check valve, said other check valve having a restrictor to prevent air from flowing into said direction control valve, and a locking member attached to the piston rod of said cylinder and an engaging member attached to said movable member and being adapted to engage with and lock said locking member.

2. A pneumatically movable device as claimed in claim 1 in combination with a robot system for extracting injection molded or die cast products, wherein said movable member is a chuck holding plate of the robot system.

3. A pneumatically movable device as claimed in claim 1, wherein said actuator is in the form of an air cylinder.

4. A pneumatically movable device as claimed in claim 1, wherein said locking member is formed as a hook and said engaging member is formed as a claw.

* * * * *